US005900773A

United States Patent [19]

Susak

[11] Patent Number: 5,900,773

[45] Date of Patent: May 4, 1999

[54] PRECISION BANDGAP REFERENCE CIRCUIT

[75] Inventor: David M. Susak, Phoenix, Ariz.

[73] Assignee: Microchip Technology Incorporated, Chandler, Ariz.

[21] Appl. No.: 08/837,894

[22] Filed: Apr. 22, 1997

[51] Int. Cl.[6] ..... G05F 1/10

[52] U.S. Cl. ..... 327/539; 327/513; 327/541; 327/543; 323/313; 323/315; 323/316

[58] Field of Search ..... 327/513, 538, 327/539, 540, 541, 543; 323/312, 313, 315, 316

[56] References Cited

U.S. PATENT DOCUMENTS

| | | | |
|---|---|---|---|
| 4,593,208 | 6/1986 | Single | 327/539 |
| 4,978,868 | 12/1990 | Giordano et al. | 327/539 |
| 5,087,830 | 2/1992 | Cave et al. | 327/539 |
| 5,614,816 | 3/1997 | Nahas | 327/539 |
| 5,666,046 | 9/1997 | Mietus | 323/316 |

*Primary Examiner*—Timothy P. Callahan
*Assistant Examiner*—Jung Ho Kim
*Attorney, Agent, or Firm*—Harry M. Weiss; Jeffrey D. Moy; Harry M. Weiss & Associates, P.C.

[57] ABSTRACT

A precision bandgap reference circuit which uses an operational amplifier that has the positive and negative input terminals connected to a diode/resistor combination and a diode respectively. The output of the operational amplifier drives a diode connected PMOS transistor which regulates current sources which drives into the diode/resistor combination and the diode inputs to the operational amplifier. This allows the operational amplifier to have enough gain to minimize errors across the diode/resistor combination and the diode inputs to the operational amplifier. This also allows an output stage driven by the operational amplifier to be biased with a Proportional To Absolute Temperature (PTAT) current which is well controlled.

25 Claims, 2 Drawing Sheets

PRECISION BANDGAP REFERENCE CIRCUIT

BACKGROUND OF THE INVENTION

1. Field of the Invention

This invention relates generally to bandgap reference circuits and, more specifically, to a precision bandgap reference circuit which is insensitive to temperature, supply voltage and process variations.

2. Description of the Prior Art

FIG. 1 shows the most common CMOS bandgap reference circuit. The main problem with current CMOS bandgap reference circuits is that the output reference voltage varies due to temperature, supply voltage, and process variations. Furthermore, as can be seen from FIG. 1, the basic CMOS bandgap reference circuit has very low gain which may cause errors across the resistor/diode combination input and diode input. The basic CMOS bandgap reference circuit is also unbalanced. The drain to source voltages of the transistors are different since one is connected as a diode and one is not.

Therefore, a need existed to provide a precision bandgap reference circuit. The precision bandgap reference circuit must be insensitive to temperature, supply voltage and process variations. The precision bandgap reference circuit must be produced on a standard CMOS process. The precision bandgap reference circuit must also increase the gain in order to minimize errors across the resistor/diode combination input and the diode input. The output stage of the precision bandgap reference circuit must also be biased with a Proportional To Absolute Temperature (PTAT) current thereby generating a well controlled and insensitive bandgap reference circuit.

SUMMARY OF THE INVENTION

In accordance with one embodiment of the present invention, it is an object of the present invention to provide an improved bandgap reference circuit.

It is another object of the present invention to provide a precision bandgap reference circuit that is insensitive to temperature, supply voltage and process variations.

It is still another object of the present invention to provide a precision bandgap reference circuit that is produced on a standard CMOS process.

It is still a further object of the present invention to provide a precision bandgap reference circuit that has an increased gain in order to minimize errors across resistor/diode combination input and diode input.

It is still another object of the present invention to provide a precision bandgap reference circuit that has an output stage which is biased with a Proportional To Absolute Temperature (PTAT) current thereby generating a well controlled and insensitive bandgap reference circuit.

BRIEF DESCRIPTION OF THE PREFERRED EMBODIMENTS

In accordance with one embodiment of the present invention, a precision bandgap reference circuit is disclosed. The precision bandgap reference circuit uses an input circuit for generating a Proportional To Absolute Temperature (PTAT) current. An operational amplifier circuit is coupled to the input circuit for accurately transferring the PTAT current. A current mirroring circuit is coupled to the operational amplifier and to the input circuit for forming a feedback loop with the operational amplifier and for outputting the PTAT current generated by the input circuit and accurately transferred by the operational amplifier. An output reference circuit is coupled to the current mirroring circuit for receiving the PTAT current generated by the input circuit and accurately transferred by the operational amplifier and for generating a reference voltage having a temperature coefficient of approximately zero.

The foregoing and other objects, features, and advantages of the invention will be apparent from the following, more particular, description of the preferred embodiments of the invention, as illustrated in the accompanying drawings.

DETAILED DESCRIPTION OF THE PREFERRED EMBODIMENTS

Figure 1:
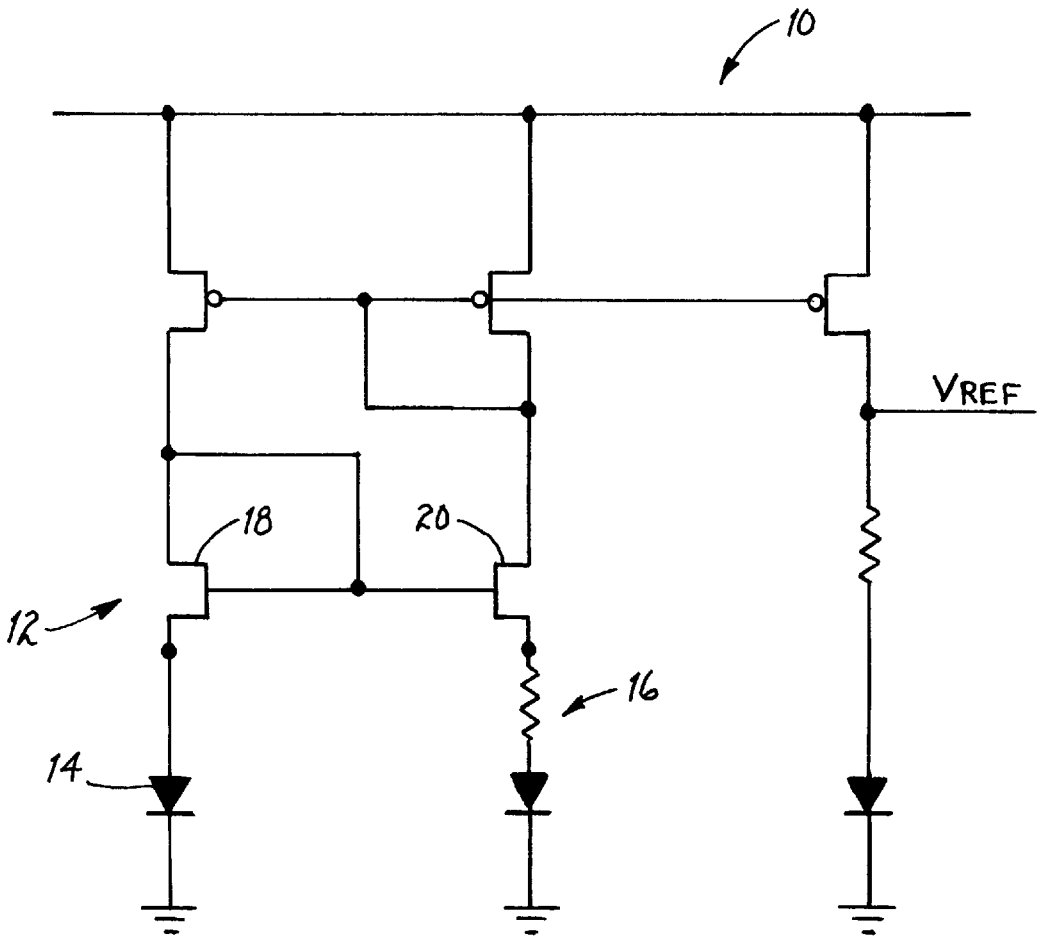
FIG. 1 (PRIOR ART)
FIG. 1 is an electrical schematic of a prior art bandgap reference circuit.

Referring to FIG. 1, a prior art CMOS bandgap reference circuit 10 (hereinafter circuit 10) is shown. The circuit 10 is comprised of an operational amplifier 12. A diode 14 is coupled to the positive terminal of the operational amplifier 12 while a resistor/diode combination 16 is coupled to the negative input of the operational amplifier 12. As stated above, the main problem with circuit 10 is that the output reference voltage $V_{REF}$ varies due to temperature, supply voltage, and process variations. Furthermore, the operational amplifier 12 has very low gain which may cause errors across the resistor/diode combination 16 input stage as well as the diode 14 input stage. The operational amplifier 12 is also unbalanced. The drain to source voltages of the transistors 18 and 20 of the operational amplifier 12 are different and vary with supply voltage causing errors.

Figure 2:
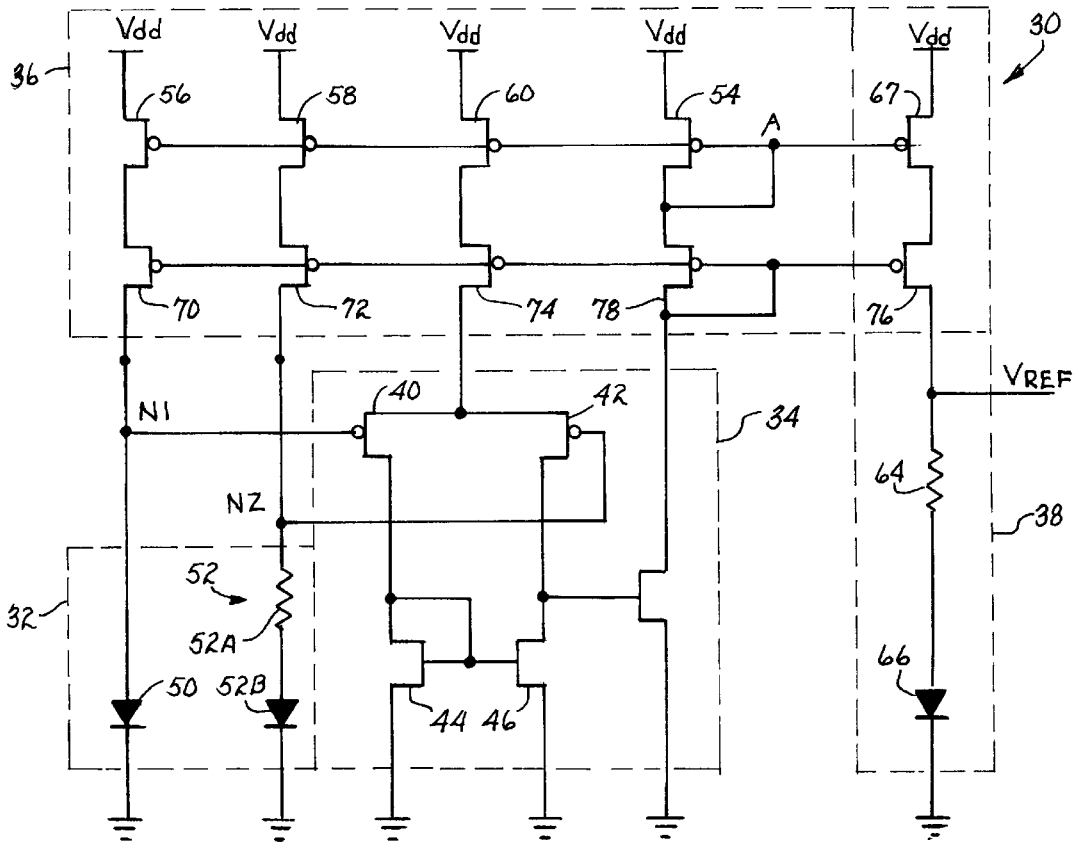
FIG. 2 is an electrical schematic of the precision bandgap reference circuit of the present invention.

Referring to FIG. 2, the precision bandgap reference circuit 30 (hereinafter circuit 30) is shown. The circuit 30 comprises a plurality of elements one of which is an operational amplifier 34. A current mirroring circuit 36 is coupled to input and output terminals of the operational amplifier 34 to form a feedback loop. The feedback loop formed by the current mirroring circuit 36 allows a current to flow which forces the input nodes N1 and N2 of the operational amplifier 34 to be equal. This allows an input circuit 32 to generate a Proportional To Absolute Temperature (PTAT) current. The PTAT current is sent to the operational amplifier 34. The operational amplifier 34 will accurately transfer the PTAT current to the current mirroring circuit 36. The mirrored PTAT current is used to drive an output circuit 38 which generates a reference voltage (i.e., approximately 1.2 volts with a temperature coefficient of zero (i.e., bandgap voltage) in the preferred embodiment).

The operational amplifier 34 is a three (3) terminal operational amplifier. Unlike the prior art operational amplifier 12 (FIG. 1), the operational amplifier 34 is balanced. In the preferred embodiment of the present invention, the operational amplifier is comprised of five CMOS transistors. A first transistor 40 has a gate terminal which is used as the positive input to the operational amplifier 34. The source terminal of the first transistor 40 is coupled to the current mirroring circuit 36 as well as to the source terminal of a second transistor 42. The gate terminal of the second transistor 42 is used as a negative input to the operational amplifier 34. The third transistor 44 has drain, gate, and source terminals wherein the drain terminal of the third transistor 44 is coupled to the drain terminal of the first transistor 40, the gate terminal of the third transistor 44 is coupled to the drain terminals of the first transistor 40 and the third transistor 44, and the source terminal of the third transistor 44 is coupled to ground. The fourth transistor 46 also has drain, gate, and source terminals. The drain terminal of the fourth transistor 46 is coupled to the drain terminal of the second transistor 42. The gate terminal of the fourth transistor 46 is coupled to the drain and gate terminals of the third transistor 44. The source terminal of the fourth transistor 46 is coupled to ground. The fifth transistor 48 also has drain, gate, and source terminals. The drain terminal of the fifth transistor 48 is coupled to the current mirroring circuit 36. The gate terminal of the fifth transistor 36 is coupled to the drain terminal of the fourth transistor 46 and to the drain terminal of the second transistor 42. The source terminal of the fifth transistor 48 is coupled to ground. In the preferred embodiment of the present invention, transistors 40 and 42 are PMOS transistors, and transistors 44, 46, and 48 are NMOS transistors.

The gate terminals of the transistors 40 and 42 are used as the input terminals N1 and N2 of the operational amplifier 34. Thus, both gate terminals of the transistors 40 and 42 are also coupled to the input circuit 32. In the preferred embodiment of the present invention, the input circuit 32 is comprised of a first diode 50. The anode of the first diode 50 is coupled to the gate terminal of the first transistor 40. The cathode of the first diode 50 is coupled to ground. The input circuit 32 is further comprised of a resistor/diode combination 52. One terminal of a resistor 52A is coupled to the gate terminal of the second transistor 42. A second terminal of the resistor 52A is coupled to an anode terminal of a second diode 52B. Like the first diode 50, the cathode of the second diode 52B is coupled to ground.

Ideally, the voltage at the input nodes N1 and N2 of the operational amplifier 34 should be equal. If the voltages are approximately equal, the diodes 50 and 52B, in this embodiment, must be sized such that a voltage drop of approximately 54 millivolts will appear across the resistor 52A. This will generate a PTAT current which is driven through a resistor 64 and diode 66 series combination of the output circuit 38. The resistor 64 and diode 66 series combination must be sized to generate a voltage of approximately 1.2 volts (i.e., bandgap voltage) having a temperature coefficient of zero.

The drain terminal of the transistor 48 is coupled to a diode connected transistor 54 of the current mirroring circuit 36 thereby setting up a reference on bias line node A. By coupling the output of the operational amplifier 34 to a diode connected transistor 54 of the current mirroring circuit 36, the circuit 30 comes into regulation generating a well controlled current that can be equally distributed by the current mirroring circuit through transistors 54, 56, 58, 60, and 62. That is assuming that the aforementioned transistors (i.e., transistors 54, 56, 58, 60, and 62) are all equally sized and are all the same type. In the preferred embodiment of the present invention, transistors 54, 56, 58, 60, and 62 are PMOS transistors.

By having a well controlled current mirror comprising transistors 54, 56, 58, 60, and 62, the drain current of transistors 56 and 58 are forced to be equal. This forces the voltages at the input nodes N1 and N2 to the operational amplifier 34 to be equal. If the diodes 50 and 52B are sized such that a voltage drop of approximately 54 millivolts appears across the resistor 52A, a PTAT current is generated which if driven through a properly sized resistor 64 and diode 66 series combination of the output circuit 38, will generate a bandgap voltage of approximately 1.2 volts with a temperature coefficient of zero. It should be noted that the diode 52B must be sized substantially greater than the diode 50. If the diode 52B is not substantially greater than diode 50, a sufficient amount of negative feedback will not be generated to stabilize the feedback loop.

As stated above, the well controlled current is also mirrored through transistors 54 and 60. Since the current through the transistors 54 and 60 will be approximately the same, the transistors 44, 46, and 48 may be sized such that the drain to source voltage of transistor 46 will be approximately equal to the drain to source voltage of transistor 44. This means that the drain to gate voltage of transistor 46 will be approximately zero. As the drain voltage gets closer and closer to the source voltage, the output impedance of the transistor 46 is dramatically reduced causing errors.

In order to increase the accuracy of the circuit 30, the resistors 52A and 64 should be similar types of resistors (i.e., polymer, diffused, etc.). This will cancel out process variations in the resistors 52A and 64 thereby increasing the accuracy of the circuit 30.

The circuit 30 may further comprise a cascode circuit 68. The cascode circuit 68 is coupled to the current mirroring circuit 36 and to the output circuit 38. The cascode circuit 68 is comprised of five transistors 70, 72, 74, 76, and 78. In the preferred embodiment of the present invention, the five transistors 70, 72, 74, 76, and 78 are PMOS transistors.

Each of the transistors 70, 72, 74, 76, and 78 are individually coupled in series to a separate transistor of the current mirroring circuit 36 and the output circuit 38. The five transistors 70, 72, 74, 76, and 78 are coupled such that transistor 70 is coupled in series to transistor 56. Thus, the source terminal of transistor 70 is coupled to the drain terminal of transistor 56, and the drain terminal of transistor 70 is coupled to the input terminal N1 of the operational amplifier 34. In a similar manner, the source terminal of transistor 72 is coupled to the drain terminal of transistor 58, and the drain terminal of transistor 72 is coupled to the input terminal N2 of the operational amplifier 34. The transistor 74 is coupled in series with transistor 60 such that the source terminal of transistor 74 is coupled to the drain terminal of transistor 60, and the drain terminal of transistor 74 is coupled to the operational amplifier 34. Transistor 62 of the output circuit 38 is coupled in series to transistor 76. The source terminal of transistor 76 is coupled to the drain terminal of transistor 62, and the drain terminal of transistor 76 is coupled to the resistor 64 of the output circuit 38. Transistor 78 is a diode connect transistor which is coupled in series with transistor 54. The source terminal of transistor 78 is coupled to the gate and drain terminals of transistor 54, and the drain terminal of transistor 78 is coupled to the gate terminal of transistor 78 and to the operational amplifier 34. The gate terminals of transistors 70, 72, 74, 76, and 78 are all coupled together.

The cascode circuit 68 dramatically increases the output impedance of transistors 54, 56, 58, 60 and 62. This increases the overall gain of the feedback loop around the operational amplifier 34. This also minimizes the voltage sensitivity of the circuit 30. Thus, as the supply voltage $V_{dd}$ changes, the current of transistors 54, 56, 58, and 60, as well as transistor 62 which drives into $V_{REF}$, will not change as function of supply.

While the invention has been particularly shown and described with reference to preferred embodiments thereof, it will be understood by those skilled in the art that the foregoing and other changes in form, and details may be made therein without departing from the spirit and scope of the invention.

I claim:

1. A precision bandgap reference circuit comprising, in combination:

input circuit for generating a PTAT current;

an operational amplifier circuit coupled to said input circuit for receiving and accurately transferring said PTAT current;

current mirroring circuit coupled to said operational amplifier and to said input circuit for forming a feedback loop with said operational amplifier and for outputting said PTAT current generated by said input circuit and accurately transferred by said operational amplifier;

output reference circuit coupled to said current mirroring circuit for receiving said PTAT current generated by said input circuit and accurately transferred by said operational amplifier and for generating a reference voltage having a temperature coefficient of approximately zero;

wherein said input circuit comprises:

a first diode coupled to said current mirroring circuit and to a first input terminal of said operational amplifier;

a resistor coupled to said current mirroring circuit and to a second terminal of said operational amplifier; and a second diode coupled in series to said resistor.

2. A precision bandgap reference circuit in accordance with claim 1 wherein said second diode is sized greater than said first diode to generate negative feedback to stabilize said feedback loop.

3. A precision bandgap reference circuit in accordance with claim 1 wherein said current mirroring circuit comprises:

a first transistor wherein said first transistor is a diode connect transistor having a drain, gate and source terminals wherein said source terminal of said first transistor is coupled to a supply voltage source, said gate terminal of said first transistor is coupled to said drain terminal of said first transistor, and said drain terminal of said first transistor is coupled to said operational amplifier;

a second transistor having a drain, gate, and source terminals wherein said source terminal of said second transistor is coupled to said supply voltage source, said gate terminal of said second transistor is coupled to said gate terminal of said first transistor, and said drain terminal of said second transistor is coupled to a first input terminal of said operational amplifier;

a third transistor having a drain, gate, and source terminals wherein said source terminal of said third transistor is coupled to said supply voltage source, said gate terminal of said third transistor is coupled to said gate terminal of said first transistor, and said drain terminal of said third transistor is coupled to a second input terminal of said operational amplifier; and a fourth transistor having a drain, gate, and source terminals wherein said source terminal of said fourth transistor is coupled to said supply voltage source, said gate terminal of said fourth transistor is coupled to said gate terminal of said first transistor, and said drain terminal of said fourth transistor is coupled to said operational amplifier.

4. A precision bandgap reference circuit in accordance with claim 3 wherein said first transistor, said second transistor, said third transistor, and said fourth transistor are all equally sized transistors.

5. A precision bandgap reference circuit in accordance with claim 4 wherein said first transistor, said second transistor, said third transistor, and said fourth transistor are all PMOS transistors.

6. A precision bandgap reference circuit in accordance with claim 1 wherein said output reference circuit comprises:

a transistor having drain, gate, and source terminals wherein said source terminal is coupled to a supply voltage source and said gate terminal is coupled to said current mirroring circuit;

a resistor coupled to said drain terminal of said transistor; and a diode coupled in series to said resistor.

7. A precision bandgap reference circuit in accordance with claim 6 wherein said transistor is a PMOS transistor.

8. A precision bandgap reference circuit in accordance with claim 1 wherein said operational amplifier comprises:

a first transistor having drain, gate, and source terminals wherein said source terminal of said first transistor is coupled to said current mirroring circuit and said gate terminal of said first transistor is coupled to said input circuit;

a second transistor having drain, gate, and source terminals wherein said source terminal of said second transistor is coupled to said current mirroring circuit and to said source terminal of said first transistor, and said gate terminal of said second transistor is coupled to said input circuit;

a third transistor having drain, gate, and source terminals wherein said drain terminal of said third transistor is coupled to said drain terminal of said first transistor, said gate transistor of said third transistor is coupled to said drain terminals of said first transistor and said third transistor, and said source terminal of said third transistor is coupled to ground;

a fourth transistor having drain, gate, and source terminals wherein said drain terminal of said fourth transistor is coupled to said drain terminal of said second transistor, said gate terminal of said fourth transistor is coupled to said gate terminal and said drain terminal of said third transistor, and said source terminal of said fourth transistor is coupled to ground; and a fifth transistor having drain, gate, and source terminals wherein said drain terminal of said fifth transistor is coupled to said current mirroring circuit, said gate terminal of said fifth transistor is coupled to said drain terminal of said fourth transistor and said drain terminal of said second transistor, and said source terminal of said fifth transistor is coupled to ground.

9. A precision bandgap reference circuit in accordance with claim 8 wherein said first transistor and said second transistor of said operational amplifier are PMOS transistors.

10. A precision bandgap reference circuit in accordance with claim 8 wherein said third transistor, said fourth transistor, and said fifth transistor of said operational amplifier are NMOS transistors.

11. A precision bandgap reference circuit in accordance with claim 8 wherein said third transistor, said fourth transistor, and said fifth transistor of said operational amplifier are sized to make a drain to source voltage of said fourth transistor of said operational amplifier approximately equal to a drain to source voltage of said third transistor of said operational amplifier.

12. A precision bandgap reference circuit in accordance with claim 1 further comprising a cascode circuit coupled to said current mirroring circuit and coupled to said output reference circuit to increase overall gain of said feedback loop around said operational amplifier and to minimize voltage sensitivity of said precision bandgap reference circuit.

13. A precision bandgap reference circuit in accordance with claim 12 wherein said cascode circuit comprises:

a first transistor having a drain, gate and source terminals wherein said source terminal of said first transistor is coupled to said current mirroring circuit, and said drain terminal of said first transistor is coupled to said input circuit;

a second transistor having a drain, gate, and source terminals wherein said source terminal of said second transistor is coupled to said current mirroring circuit, said gate terminal of said second transistor is coupled to said gate terminal of said first transistor, and said drain terminal of said second transistor is coupled to said input circuit;

a third transistor having a drain, gate, and source terminals wherein said source terminal of said third transistor is coupled to said current mirroring circuit, said gate terminal of said third transistor is coupled to said gate terminal of said second transistor, and said drain terminal of said third transistor is coupled to said operational amplifier;

a fourth transistor having a drain, gate, and source terminals wherein said source terminal of said fourth transistor is coupled to said output reference circuit, said gate terminal of said fourth transistor is coupled to said gate terminal of said third transistor, and said drain terminal of said fourth transistor is coupled to said output reference circuit; and a fifth transistor having a drain, gate, and source terminals wherein said source terminal of said fifth transistor is coupled to said current mirroring circuit, said gate terminal of said fifth transistor is coupled to said gate terminal of said fourth transistor and to said drain terminal of said fifth transistor, and said drain terminal of said fifth transistor is coupled to said operational amplifier.

14. A precision bandgap reference circuit in accordance with claim 13 wherein said first transistor, said second transistor, said third transistor, said fourth transistor, and said fifth transistor of said cascode circuit are PMOS transistors.

15. A precision bandgap reference circuit comprising, in combination:

an operational amplifier circuit for receiving and accurately transferring a Proportional To Absolute Temperature (PTAT) current, said operational amplifier comprising:

a first transistor having drain, gate, and source terminals wherein said source terminal of said first transistor is coupled to a current mirroring circuit and said gate terminal of said first transistor is coupled to an input circuit;

a second transistor having drain, gate, and source terminals wherein said source terminal of said second transistor is coupled to said current mirroring circuit and to said source terminal of said first transistor, and said gate terminal of said second transistor is coupled to said input circuit;

a third transistor having drain, gate, and source terminals wherein said drain terminal of said third transistor is coupled to said drain terminal of said first transistor, said gate transistor of said third transistor is coupled to said drain terminals of said first transistor and said third transistor, and said source terminal of said third transistor is coupled to ground;

a fourth transistor having drain, gate, and source terminals wherein said drain terminal of said fourth transistor is coupled to said drain terminal of said second transistor, said gate terminal of said fourth transistor is coupled to said gate terminal and said drain terminal of said third transistor, and said source terminal of said fourth transistor is coupled to ground; and a fifth transistor having drain, gate, and source terminals wherein said drain terminal of said fifth transistor is coupled to said current mirroring circuit, said gate terminal of said fifth transistor is coupled to said drain terminal of said fourth transistor and said drain terminal of said second transistor, and said source terminal of said fifth transistor is coupled to ground;

an input circuit coupled to said operational amplifier and to said current mirroring circuit for generating said PTAT current, said input circuit comprising:

a first diode coupled to said current mirroring circuit and to said gate terminal of said first transistor of said operational amplifier;

a first resistor coupled to said current mirroring circuit and to said gate terminal of said second transistor of said operational amplifier; and a second diode coupled in series to said first resistor;

current mirroring circuit coupled to said operational amplifier and to said input circuit for forming a feedback loop with said operational amplifier and for outputting said PTAT current generated by said input circuit and accurately transferred by said operational amplifier;

output reference circuit coupled to said current mirroring circuit for receiving said PTAT current generated by said input circuit and accurately transferred by said operational amplifier and for generating a reference voltage having a temperature coefficient of approximately zero, said output reference circuit comprising:

a sixth transistor having drain, gate, and source terminals wherein said source terminal of said sixth transistor is coupled to a supply voltage source and said gate terminal of said sixth transistor is coupled to said current mirroring circuit;

a second resistor coupled to said drain terminal of said sixth transistor; and a third diode coupled in series to said second resistor.

16. A precision bandgap reference circuit in accordance with claim 15 wherein said current mirroring circuit comprises:

a seventh transistor wherein said seventh transistor is a diode connect transistor having a drain, gate and source terminals wherein said source terminal of said seventh transistor is coupled to said supply voltage source, said gate terminal of said seventh transistor is coupled to said drain terminal of said seventh transistor and to said gate terminal of said sixth transistor, and said drain terminal of said seventh transistor is coupled to said drain terminal of said fifth transistor;

an eighth transistor having a drain, gate, and source terminals wherein said source terminal of said eighth transistor is coupled to said supply voltage source, said gate terminal of said eighth transistor is coupled to said gate terminal of said seventh transistor, and said drain terminal of said eighth transistor is coupled to said first diode and to said gate terminal of said first transistor;

a ninth transistor having a drain, gate, and source terminals wherein said source terminal of said ninth transistor is coupled to said supply voltage source, said gate terminal of said ninth transistor is coupled to said gate terminal of said seventh transistor, and said drain terminal of said ninth transistor is coupled to said first resistor and to said gate terminal of said second transistor; and a tenth transistor having a drain, gate, and source terminals wherein said source terminal of said tenth transistor is coupled to said supply voltage source, said gate terminal of said tenth is coupled to said gate terminal of said seventh transistor, and said drain terminal of said tenth transistor is coupled to said source terminals of said first transistor and said second transistor.

17. A precision bandgap reference circuit in accordance with claim 15 wherein said second diode is sized greater than said first diode to generate negative feedback to stabilize said feedback loop.

18. A precision bandgap reference circuit in accordance with claim 15 wherein said sixth transistor, seventh transistor, said eighth transistor, said ninth transistor, and said tenth transistor are all equally sized transistors.

19. A precision bandgap reference circuit in accordance with claim 18 wherein said sixth transistor, seventh transistor, said eighth transistor, said ninth transistor, and said tenth transistor are all PMOS transistors.

20. A precision bandgap reference circuit in accordance with claim 15 wherein said first transistor and said second transistor of said operational amplifier are PMOS transistors.

21. A precision bandgap reference circuit in accordance with claim 15 wherein said third transistor, said fourth transistor, and said fifth transistor of said operational amplifier are NMOS transistors.

22. A precision bandgap reference circuit in accordance with claim 21 wherein said third transistor, said fourth transistor, and said fifth transistor of said operational amplifier are sized to make a drain to source voltage of said fourth transistor of said operational amplifier approximately equal to a drain to source voltage of said third transistor of said operational amplifier.

23. A precision bandgap reference circuit in accordance with claim 15 further comprising a cascode circuit coupled to said current mirroring circuit and coupled to said output reference circuit to increase overall gain of said feedback loop around said operational amplifier and to minimize voltage sensitivity of said precision bandgap reference circuit.

24. A precision bandgap reference circuit in accordance with claim 23 wherein said cascode circuit comprises:

an eleventh transistor having a drain, gate and source terminals wherein said source terminal of said eleventh transistor is coupled to said drain terminal of said eighth transistor, and said drain terminal of said eleventh transistor is coupled to said first diode of said input circuit and to said gate terminal of said first transistor;

a twelfth transistor having a drain, gate, and source terminals wherein said source terminal of said twelfth transistor is coupled to said drain terminal of said ninth transistor, said gate terminal of said twelfth transistor is coupled to said gate terminal of said eleventh transistor, and said drain terminal of said twelfth transistor is coupled to said first resistor of said input circuit;

a thirteenth transistor having a drain, gate, and source terminals wherein said source terminal of said thirteenth transistor is coupled to said drain terminal of said tenth transistor, said gate terminal of said thirteenth transistor is coupled to said gate terminal of said twelfth transistor, and said drain terminal of said thirteenth transistor is coupled to said source terminals of said first transistor and said second transistor;

a fourteenth transistor having a drain, gate, and source terminals wherein said source terminal of said fourteenth transistor is coupled to said drain terminal of said sixth transistor, said gate terminal of said fourteenth is coupled to said gate terminal of said thirteenth transistor, and said drain terminal of said fourteenth transistor is coupled to said second resistor of said output reference circuit; and a fifteenth transistor having a drain, gate, and source terminals wherein said source terminal of said fifteenth transistor is coupled to said drain and gate terminals of said seventh, said gate terminal of said fifteenth transistor is coupled to said gate terminal of said fourteenth transistor and to said drain terminal of said fifteenth transistor, and said drain terminal of said fifteenth transistor is coupled to said drain terminal of said fifth transistor.

25. A precision bandgap reference circuit in accordance with claim 24 wherein said eleventh transistor, said twelfth transistor, said thirteenth transistor, said fourteenth transistor, and said fifteenth transistor are PMOS transistors.

* * * * *